United States Patent [19]

Yeung

[11] 3,997,045

[45] Dec. 14, 1976

[54] ROULETTE SAVINGS BOX

[75] Inventor: Yim Hei Joseph Yeung, Kwun Tong, Kowloon, Hong Kong

[73] Assignee: Joylite Manufacturing Co., Ltd., Hong Kong

[22] Filed: June 13, 1975

[21] Appl. No.: 586,667

[52] U.S. Cl. ..... 194/94; 194/DIG. 9; 46/4

[51] Int. Cl.[2] ..... G07F 5/00

[58] Field of Search ..... 194/94, DIG. 9, 1 R; 46/4, 2, 3; 273/142 R; 232/15; 235/100

[56] References Cited

UNITED STATES PATENTS 508,019 11/1893 Hunter ..... 46/3

*Primary Examiner*—Allen N. Knowles
*Attorney, Agent, or Firm*—Ralph B. Pastoriza

[57] ABSTRACT

A coin box has an upper structure serving as a coin chute for receiving coins and passing them to the lower box. Within the coin chute structure is a paddle wheel arrangement mounted for rotation about a horizontal axis spaced off-center of the chute portion through which a coin passes. A dropping coin strikes one of the vanes of the paddle wheel to rotate the wheel. A front face of this paddle wheel includes numerals about its periphery, visible through a window in the chute structure, such that each time a coin is received, the wheel will be rotated and come to rest in a random position.

1 Claim, 4 Drawing Figures

ROULETTE SAVINGS BOX

This invention relates to a novelty savings box structure for coins.

BACKGROUND OF THE INVENTION

Savings boxes or banks for collecting miscellaneous change, particularly for use by children are well known in the art. One criterion in designing such a savings box or portable bank is to make it attractive and thus induce a person to drop coins in the bank. An example is the well known "piggy" bank which is extremely popular with children. Other more sophisticated types of banks included mechanisms which will automatically register the amount of the coin inserted and maintain a running total. However, these latter types of banks are relatively expensive to manufacture as compared to the simplified piggy bank.

It would be desirable to provide an inexpensive savings box or bank for coins which has a novelty characteristic, preferably being capable of effecting some type of response to the insertion of a coin to serve as an inducement to save.

BRIEF DESCRIPTION OF THE PRESENT INVENTION

With the foregoing considerations in mind, the present invention contemplates a novel savings box which is inexpensive to manufacture and yet includes a novelty feature in the form of a simulated roulette wheel, caused to rotate each time a coin is inserted.

More particularly, in accord with the invention there is provided a base housing having an upper passage for receiving coins. A coin chute structure connects to the top of the base housing over the upper passage, the upper end of the chute structure having a coin receiving slot and the front of the coin chute structure having a window. A disc is rotatably mounted in a vertical plane in the coin chute structure behind the window with its axis of rotation normal to the plane of the window and spaced off-center of the coin receiving slot. The front face of this disc is provided with symbols adjacent its peripheral edge over 360° similar to a roulette wheel and visible through the window. The rear face of the disc is provided with a plurality of radially extending vanes similar to a paddle wheel, the vanes successively passing under the coin receiving slot when the disc is rotated.

With the foregoing arrangement, whenever a coin is dropped through the coin receiving slot, it will strike one of the vanes to thereby rotate the disc, the coin then passing through the upper passage into the base housing and the disc itself eventually coming to rest in a random position.

The rotation of the disc in response to insertion of a coin and the uncertainty as to which position of rest will be assumed by the wheel when it stops serve as an inducement to drop coind into the savings box.

BRIEF DESCRIPTION OF THE DRAWINGS

A better understanding of this invention will be had by referring to a preferred embodiment thereof as illustrated in the accompanying drawings in which.

DETAILED DESCRIPTION OF THE PREFERRED EMBODIMENT

Figure 1:
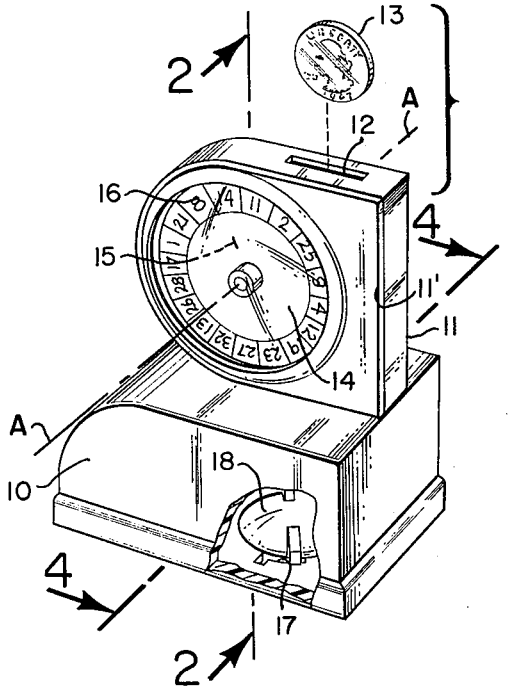
FIG. 1 is a perspective view of the roulette savings box of this invention showing a coin in exploded view above the box preparatory to being inserted in the box.

Referring first to FIG. 1 there is shown a base housing 10 and a coin chute structure 11 connected to the top of the base housing. The chute structure 11 includes a coin receiving slot 12 at its top for receiving coins such as the coin 13.

The coin chute structure 11 also has a circular front window 14 behind which there is rotatably mounted a disc 15. The disc 15 lies in a vertical plane and is arranged to rotate about a horizontal axis A—A normal to the plane of the window 14. Symbols such as numbers are provided adjacent to the periphery of the disc 15 as indicated at 16 over 360°. It will be noted that the disc 15 is mounted off-center of the coin receiving slot 12.

Shown at the lower broken away portion of the housing 10 is a cut-out defining an annular lip 17 keying a removable closure 18. As will become clearer as the description proceeds, the closure 18 is removable from the base of the housing 10 to enable coins dropped therein to be retrieved.

Figure 2:
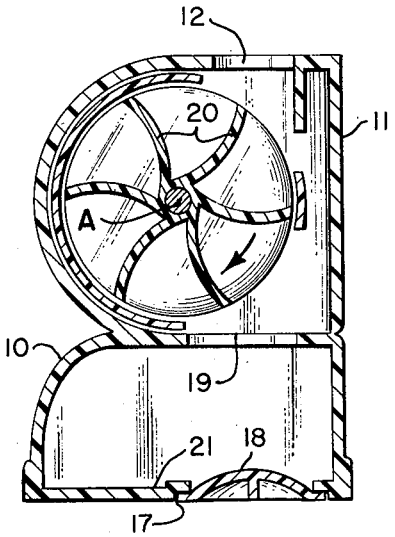
FIG. 2 is a cross section taken in the direction of the arrows 2—2 of FIG. 1.

The foregoing will become clearer by now referring to the cross section of FIG. 2 wherein it will be noted that the housing 10 includes an upper passage 19, the coin chute structure 11 being integrally formed over this passage. Further, from FIG. 2 the off-center mounting of the disc 15 relative to the coin receiving slot 12 will be evident.

In FIG. 2, a cross section of the rear portion of the disc is shown looking from the front from a position immediately behind the front face containing the symbols 16 described in FIG. 1. This rear surface includes a plurality of radially extending vanes 20 similar to a paddle wheel, the vanes successively passing under the coin receiving slot 12 when the disc rotates in the direction of the arrow. The positioning is such that when a coin is dropped through the slot 12, it will strike one of the vanes and cause the disc to rotate. The coin thereafter will drop through the upper passage 19 into the base housing 10.

As is clear from FIG. 2, the bottom of the base housing 10 is designated 21, the referred to annular lip 17 supporting lateral projections on the closure 18, these projections being rotatable with the closure to register with slots when removing the closure.

Figure 3:
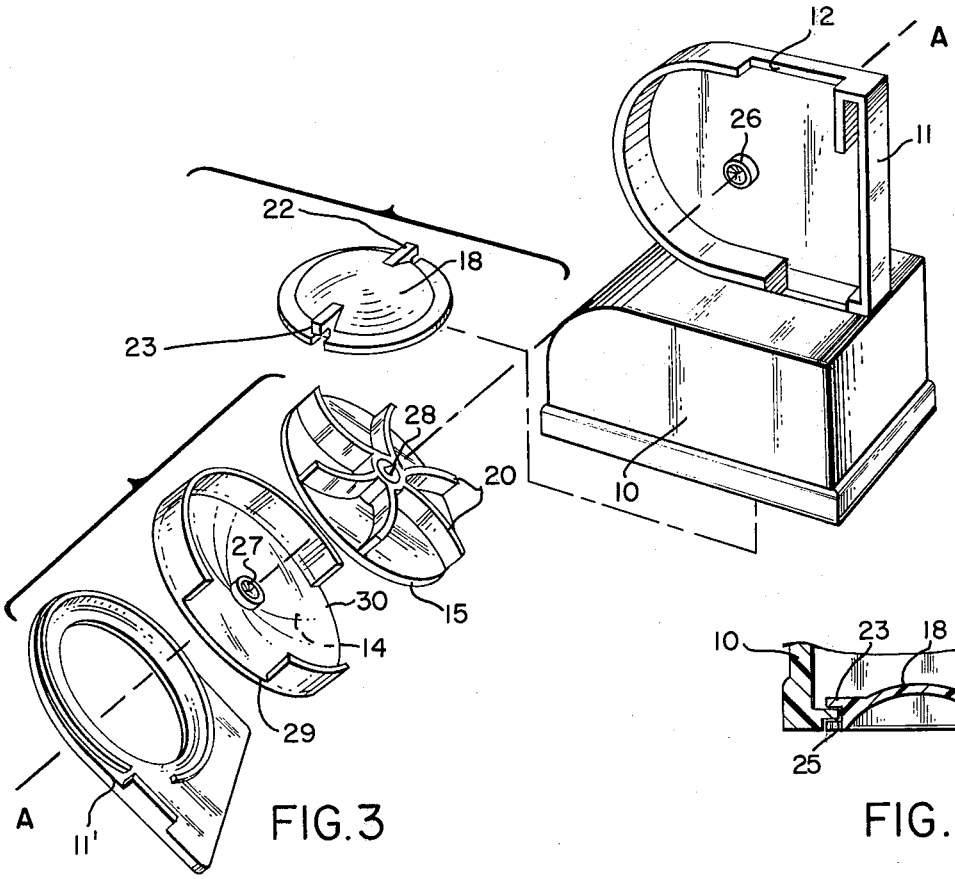
FIG. 3 is an exploded perspective view of the savings box of FIG. 1 illustrating the basic components making up the box; and, FIG. 4 is a fragmentary cross section taken in the direction of the arrows 4—4 of FIG. 1.

In the exploded view of FIG. 3, the closure 18 is shown completely separated from the base housing 10. The lateral projections are shown at 22 and 23 which overlie opposite portions of the lip 17 of the cut-out in the base.

Figure 4:
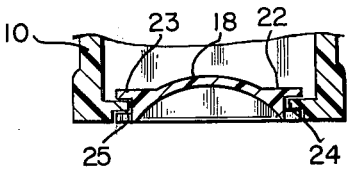

Referring for the moment to the fragmentary cross section of FIG. 4, the slots in the lip are shown at 24 and 25 which, when registering with the projections 22 and 23 permit removal of the closure 18. Insertion and rotation of the closure will cause the projections to overlie opposite portions of the lip 17 away from the slots to hold the closure in its closed position as already described heretofore.

Referring back now to the exploded view of FIG. 3, the vanes 20 on the rear of the disc 15 are clearly visible. It will also be noted that the chute structure 11 is comprised of a cover member 11' shown separated in the exploded view thus providing access to the disc therewithin. The bearing mounting for rotation of the disc takes the form of small conical cavities 26 and 27 at the central portion of the rear wall of the chute structure 11 and at the center of the window 14 respectively. A center bearing needle 28 in turn is disposed in the disc 15 and will ride within the opposed bearing cavities 26 and 27 when the parts are assembled. Cut-out portions 29 and 30 are provided on the periphery of the window 14 to define the chute passage for coins when the components are assembled as shown in FIG. 2.

As mentioned, the material for the base housing and coin chute structure is preferably plastic so that the basic housing components can be easily and inexpensively manufactured by simple injection molding.

OPERATION

In operation, and as substantially described heretofore, coins may be successively dropped through the coin receiving slot 12, the same striking at least one of the vanes 20 on its passage into the base housing 10. Heavier coins will have greater momentum and thus impart a greater rotating force to the disc as compared to lighter coins. Thus, for different denomination coins, the position at which the actuated disc comes to rest will be different and in all instances fairly random.

Ultimate retrieval of coins from the base housing 10 is readily carried out by simply rotating the closure 18 and removing it from the bottom of the housing as fully described heretofore.

As a consequence of the foregoing, there is provided an attractive and inviting savings box structure which has the desirable end advantage of inducing persons to drop coins in the slot in order to observe the ultimate rest position of the disc member.

What is claimed is:

1. A roulette savings box comprising, in combination:

a. a base housing having an upper passage for receiving coins;

b. a coin shute structure integrally formed on the top of said base housing over said upper passage, the upper end of said shute structure having a coin receiving slot, the back being closed by an integral rear wall and the front of said coin shute structure having a window;

c. a disc in a vertical plane in said coin shute structure between said window and rear wall;

d. a bearing needle axially secured in the center of said disc, said window and rear wall having small conical cavities at their central portions receiving opposite ends of said bearing needle to thereby rotatably mount said disc with its axis of rotation normal to the plane of said window and spaced off-center of said coin receiving slot, the front base of said disc having symbols adjacent to its peripheral edge over 360° similar to a roulette wheel and all being visible through said window, the rear face of said disc having a plurality of radially extending vanes curving upwardly toward said coin receiving slot as they successively pass under said coin receiving slot, the bottom of said base housing including a cut-out defining an annular lip; and, e. a closure member having projections to overlie opposite portions of said lip when rotated to a given position, said lip having opposite slots through which the projections pass to thereby provide access to the interior of said housing, whereby whenever a coin is dropped through said coin receiving slot, it will strike one of said vanes to thereby rotate said disc, said coin then passing through said upper passage into said base housing and said disc eventually coming to rest in a random position, coins collected in said housing being retrievable by removing said closure member.

* * * * *